US006707433B2

(12) United States Patent
Ohtsuka et al.

(10) Patent No.: US 6,707,433 B2
(45) Date of Patent: Mar. 16, 2004

(54) ANTENNA DEVICE

(75) Inventors: Masataka Ohtsuka, Tokyo (JP); Isamu Chiba, Tokyo (JP); Shuji Urasaki, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/258,484

(22) PCT Filed: Feb. 26, 2001

(86) PCT No.: PCT/JP01/01419

§ 371 (c)(1),
(2), (4) Date: Oct. 25, 2002

(87) PCT Pub. No.: WO02/069448

PCT Pub. Date: Sep. 6, 2002

(65) Prior Publication Data

US 2003/0090433 A1 May 15, 2003

(51) Int. Cl.[7] ..... H01Q 21/00
(52) U.S. Cl. ..... 343/844; 343/826
(58) Field of Search ..... 343/825, 826, 343/844, 853, 893

(56) References Cited

U.S. PATENT DOCUMENTS 3,702,481 A * 11/1972 Koller et al. ..... 343/844
3,852,761 A * 12/1974 Bogner ..... 343/754
4,318,106 A * 3/1982 Luedtke ..... 342/440
4,700,197 A * 10/1987 Milne ..... 343/837
5,515,060 A 5/1996 Hussain et al. ..... 342/376
6,205,224 B1 * 3/2001 Underbrink ..... 381/92

FOREIGN PATENT DOCUMENTS

| | | |
|---|---|---|
| JP | 39-3506 B1 | 4/1964 |
| JP | 1-503669 A | 12/1989 |
| JP | 2-214308 A | 8/1990 |
| JP | 7-131239 A | 5/1995 |
| JP | 7-288417 A | 10/1995 |
| JP | 10-93335 A | 4/1998 |

* cited by examiner

*Primary Examiner*—Don Wong
*Assistant Examiner*—Shih-Chao Chen
(74) *Attorney, Agent, or Firm*—Birch, Stewart, Kolasch & Birch, LLP

(57) ABSTRACT

A plurality of concentric circle array antennas each having a different radius are disposed on an identical plane, and a plurality of element antennas are arranged circumferentially in each of the concentric circle array antennas. The plurality of concentric circle array antennas are arranged at regular intervals d in most part thereof, and the concentric circle array antennas corresponding to a remaining part of the plurality of concentric circle array antennas are arranged at intervals d±0.4 to 0.6d. The radii of the part of plural concentric circles change by ±(0.4 to 0.6)d, so that it is possible to reduce a wide-angle side lobe.

6 Claims, 13 Drawing Sheets

| INTERVAL OF CONCENTRIC CIRCLES (λ) | |
|---|---|
| IRREGULAR-INTERVAL CONCENTRIC CIRCLE ARRANGNENT | REGULAR-INTERVAL CONCENTRIC CIRCLE ARRANGNENT |
| 0.5 | 0.5 |
| 0.5 | 0.5 |
| 0.5 | 0.5 |
| 0.5 | 0.5 |
| 0.5 | 0.5 |
| 0.683 | 0.5 |
| 0.772 | 0.5 |
| 0.823 | 0.5 |
| 0.855 | 0.5 |

ANTENNA DEVICE

This application is the national phase under 35 U.S.C. §371 of PCT International Application No. PCT/JP01/01419 which has an International filing date of Feb. 26, 2001, which designated the United States of America.

TECHNICAL FIELD

The present invention relates to an antenna device in which a plurality of element antennas is arranged, for example, in a communication or radar so as to form a beam.

BACKGROUND ART

FIG. 12 is a diagram showing a conventional antenna device which is disclosed in, for example, Japanese Patent Laid-Open No. 7-288417. Referring to FIG. 12, reference numeral 1 denotes element antennas which are arranged on a plane, and reference numeral 2 is concentric circles along which the plurality of element antennas 1 are arranged. Each of the element antennas 1 is connected with a feed means that adjusts an excitation amplitude or an excitation phase.

Then, the operation of the above-mentioned conventional antenna device will be described. The excitation amplitude and the excitation phase of each of the element antennas 1 are adjusted by the feed means, so that the antenna device of the present invention is capable of obtaining a desired radiation characteristic.

Also, FIG. 13 is a diagram showing another conventional antenna device which is disclosed in, for example, 1999 IEEE, AP-S, pp. 2032–2035, "Design of low side lobe circular ring arrays by element radius optimization". The figure shows the arrangement of the element antennas of an array antenna in which the element antennas 1 are arranged along the concentric circles 2. Here, reference numeral 4 denotes coordinates.

Referring to FIG. 13, a table indicative of intervals of the concentric circles represents the intervals of the concentric circles 2 by a wavelength unit. In the table, a right column shows a case in which the respective concentric circles 2 are arranged at regular intervals, whereas a left column shows a case in which the intervals of the concentric circles 2 are so adjusted as to reduce a side lobe.

Then, the operation of another conventional antenna device will be described. In the conventional antenna device, the side lobe is reduced by adjustment of the intervals of the concentric circles 2. The adjusting manner is that a desired radiation pattern is regulated, and the radius of each of the concentric circles 2 is determined sequentially from the inner side so as to approximate the desired radiation pattern.

Here, in order to avoid a quarter grating lobe stated below, the intervals of the respective concentric circles 2 are limited to one wavelength or shorter. Note that, the above document discloses that the side lobe level of a portion in the vicinity of a main beam, which is −17.7 dB in the case where the intervals of the concentric circles are equal to each other is reduced to −27.4 dB in the case where the intervals of the concentric circles are adjusted.

In the array antenna, it is general that the arrangement of the element antennas is of a rectangular arrangement or a triangular arrangement from the viewpoint of easiness in structuring a feed system or the like. In the rectangular arrangement or the triangular arrangement, when the intervals of the element antennas (hereinafter referred to as "element intervals") are widened in order to reduce the number of element antennas, the grating lobe having substantially the same level as that of the main lobe occurs, resulting in a problem such as the radiation in an unnecessary direction, or the like. On the contrary, in the concentric circle arrangement described in the above-mentioned conventional example, there is advantageous in that a definite grating lobe does not occur even if the element intervals are widened.

However, even in the concentric circle arrangement, when the element intervals are widened, a side lobe having a level of some degree which should be regarded as a quarter grating lobe over a wide angle occurs, with the result that there may arise a problem from the viewpoint of the unnecessary radiation suppression.

FIG. 11(*a*) shows one example. FIG. 11(*a*) is a diagram showing the radiation pattern (radiation characteristic) of an array antenna in which 18 concentric circles are arranged at regular intervals. The element antennas 1 are arranged relatively thickly on a circumference of each of the concentric circles 2 to prevent a high side lobe from occurring due to the widened element intervals in the circumferential direction. Also, the element intervals are equal to each other along the circumferential direction of all the concentric circles 2, and all of the element antennas 1 are equal to each other in amplitude.

An abscissa axis u of FIG. 11(*a*) represents a u-coordinate (which will be described in the description of the embodiments) which corresponds to a wave-number space, and a main beam is structured when u=0. When the intervals of the concentric circles 2 are widened, a visible region where the radiation pattern appears in a real space is widened. For example, in the case where the main beam is along a crest direction which is perpendicular to an antenna plane, the region of $0 \leqq u \leqq 6.28$ becomes the radiation pattern of the real space when the intervals of the concentric circles 2 are $1\lambda$ ($\lambda$ is a wavelength), and the region of $0 \leqq u \leqq 12.57$ becomes the radiation pattern of the real space when the intervals of the concentric circles 2 are $2\lambda$.

As is understood from FIG. 11(*a*), when the intervals of the concentric circles 2 become larger than about $1\lambda$, the side lobe of −20 dB level which is relatively large appears over the wide angle. The appearance of the side lobe depends on the intervals of the concentric circles 2, and in the case where the main beam is scanned over the wide angle, the side lobe appears in the real space even when the intervals of the concentric circles 2 are smaller than $1\lambda$. The wide angle side lobe level hardly changes even if the number of concentric circles 2 increases, and is about −20 dB in the case where an amplitude distribution of an opening is uniform.

As described above, in the conventional regular-interval concentric circle arrangement, there arises such a problem that the side lobe which is high in the level over the wide angle occurs when the intervals of the concentric circles 2 increase for the purpose of reducing the number of element antennas 1 or the like.

Also, in the case where the intervals of the concentric circles 2 are narrow, there is shown a manner in which the side lobe is reduced by adjusting the intervals of the concentric circles 2 as described in the other conventional antenna device. However, in the case where the intervals of the concentric circles 2 are $1\lambda$ or more, there is no proposal of the effective manner.

DISCLOSURE OF THE INVENTION

The present invention has been made in order to solve the above-mentioned problems, and therefore an object of the present invention is to obtain an antenna device which is capable of suppressing an unnecessary side lobe over the wide angle in the case where intervals of concentric circles are widened.

According to claim 1 of the present invention, there is provided an antenna device, including a plurality of concentric circle array antennas each having a different radius on an identical plane, in which a plurality of element antennas are arranged circumferentially in each of the concentric circle array antennas, in which the plurality of concentric circle array antennas are arranged at regular intervals d in most part thereof, and in which the concentric circle array antennas corresponding to a remaining part of the plurality of concentric circle array antennas are arranged at intervals d±(0.4 to 0.6)d.

According to claim 2 of the present invention, in the antenna device according to claim 1 of the invention, the interval of the plurality of concentric circle array antennas is set to one wavelength or longer.

According to claim 3 of the present invention, there is provided an antenna device, including a plurality of concentric circle array antennas each having a different radius on an identical plane, in which a plurality of element antennas are arranged circumferentially in each of the concentric circle array antennas, in which the plurality of concentric circle array antennas are divided into groups including four continuous concentric circle array antennas, and one of the four concentric circle array antennas which are included in each of the groups is arranged at an interval d±(0.4 to 0.6)d, and in which the three remaining concentric circle array antennas in each of the groups are arranged at the regular intervals d.

According to claim 4 of the present invention, in the antenna device according to claim 3 of the invention, the interval of the plurality of concentric circle array antennas is set to one wavelength or longer.

According to claim 5 of the present invention, there is provided an antenna device, including: a first concentric circle array antenna having a plurality of element antennas arranged at regular intervals in a circumferential direction and having a radius $a_n=L_n \cdot d$ where a radius coefficient is $L_n$ (n is an integer), and a reference interval of the concentric circle array antennas is d; and a second concentric circle array antenna having a plurality of element antennas arranged at regular intervals in a circumferential direction and having a radius $a_{n+1}=L_{n+1} \cdot d \pm (0.4 \text{ to } 0.6)d$.

According to claim 6 of the present invention, in the antenna device according to claim 5 of the invention, the interval of the first and second concentric circle array antennas is set to one wavelength or longer.

BEST MODES FOR CARRYING OUT THE INVENTION

First Embodiment

Figure 1:
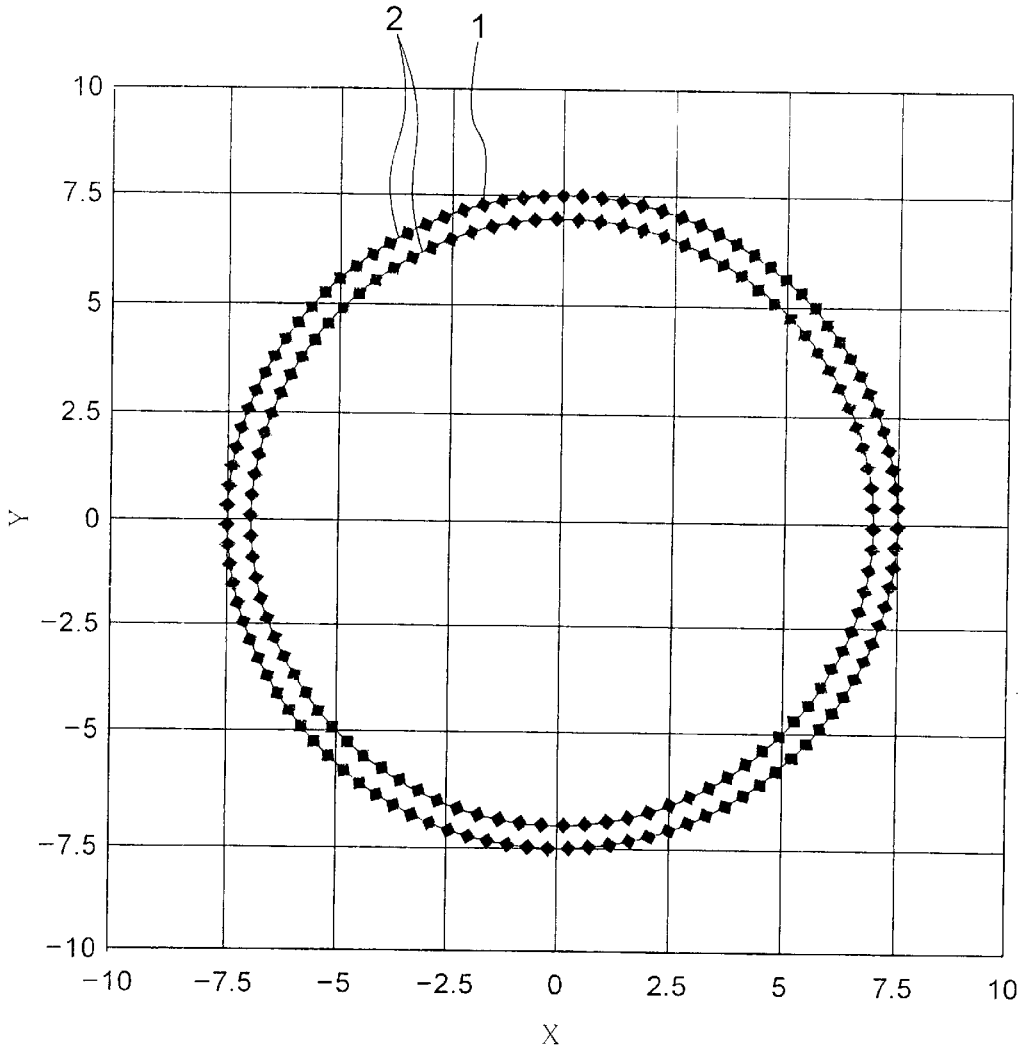
FIG. 1 is a diagram showing a structure of an antenna device in accordance with a first embodiment of the present invention.

An antenna device in accordance with a first embodiment of the present invention will be described with reference to the accompanying drawings. FIG. 1 is a diagram showing a structure of the antenna device in accordance with the first embodiment of the present invention. In the respective drawings, the identical reference numerals designate identical or equivalent parts.

Referring to FIG. 1, reference numeral 1 denotes a plurality of element antennas, and reference numeral 2 is concentric circles along which the plurality of element antennas 1 is arranged.

In this example, an operation of an array antenna in which the element antennas 1 are arranged on the concentric circles 2 will be first described so that advantages of the first embodiment become apparent.

Figure 2A:
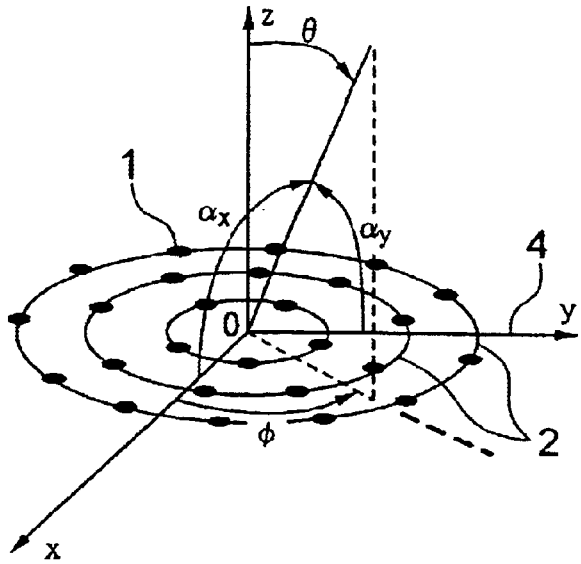
FIG. 2 are diagrams showing an arrangement of element antennas of a concentric circle arrangement array antenna in accordance with the first embodiment of the present invention.
Figure 2B:
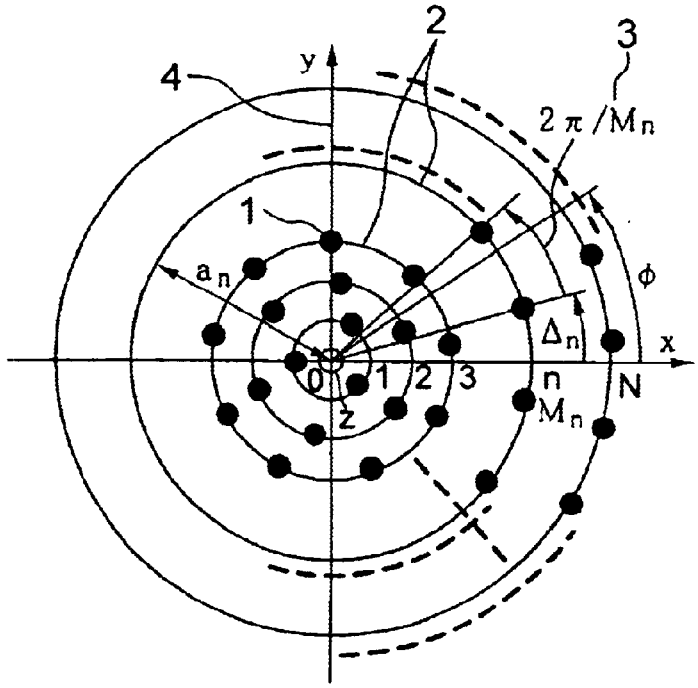

FIG. 2 are diagrams showing an arrangement of element antennas of a concentric circle arrangement array antenna, respectively. Referring to FIG. 2, reference numeral 1 denotes a plurality of element antennas, reference numeral 2 denotes a plurality of concentric circles, reference numeral 3 denotes intervals of the element antennas 1 along a circumferential direction of the respective concentric circles 2, and reference numeral 4 denotes coordinates.

Figure 3:
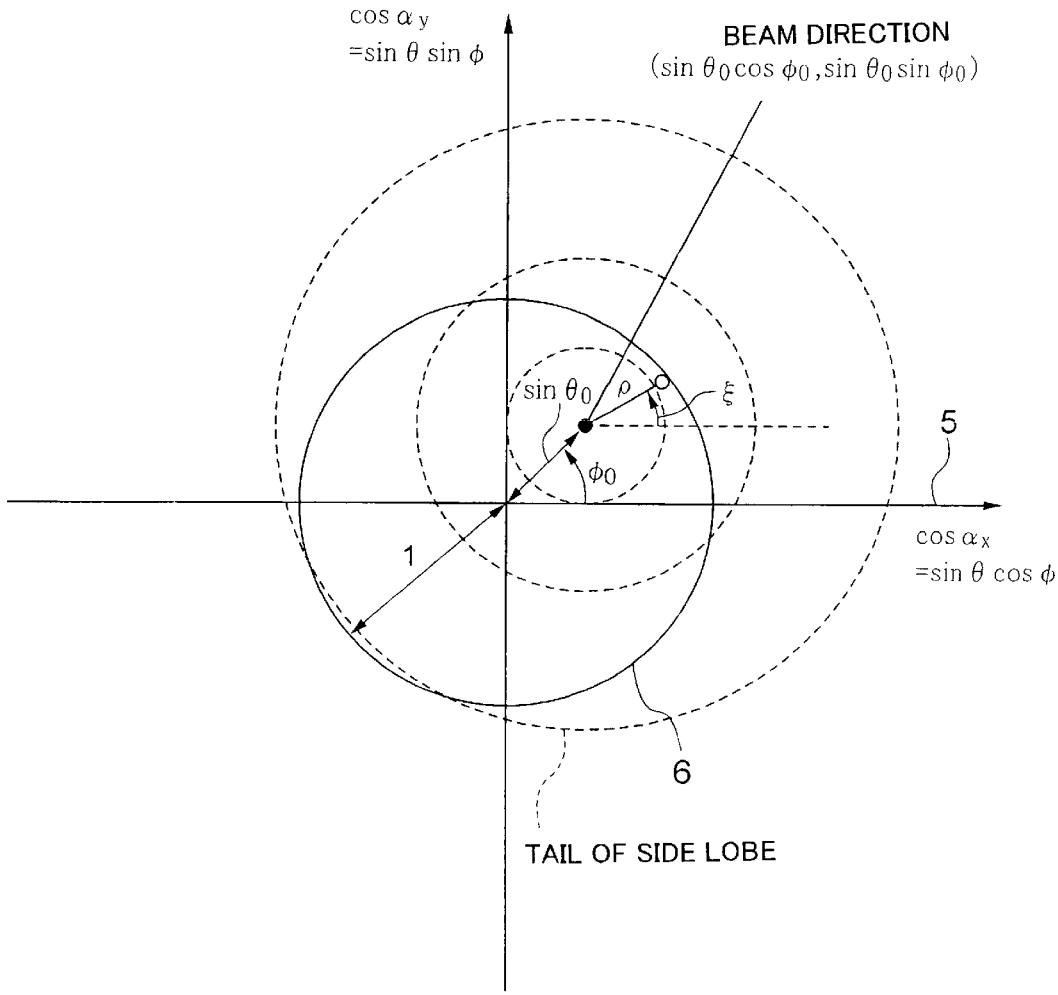
FIG. 3 is a diagram for explanation of a radiation characteristic of the antenna device in accordance with the first embodiment of the present invention in a wave-number space.

Also, FIG. 3 is a diagram for explanation of a radiation characteristic of the above-mentioned antenna device in a wave-number space. In FIG. 3, reference numeral 5 denotes wave-number space coordinates, and reference numeral 6 denotes a visible region.

Then, the structure of the antenna device according to this embodiment will be described. In the antenna device according to this embodiment, as shown in FIG. 2, the plurality of element antennas 1 are arranged on the plurality of concentric circles 2 which are assumed to be located on an x-y plane of the coordinates 4.

The concentric circles 2 are numbered sequentially in the order from the inner side as shown in FIG. 2(*b*) (1, 2, 3, . . . , n, . . . , and N), and the total number thereof is N. Also, it is assumed that the radius of an n-th concentric circle 2 is $a_n$, and the number of element antennas on the n-th concentric circle 2 is $M_n$. Also, it is assumed that the element antennas 1 are arranged at regular intervals in the circumferential direction of the concentric circle 2 within one concentric circle 2, and also all of the element antennas 1 on the n-th concentric circle 2 are equal to each other in the excitation amplitude that is designated by $E_n$. In addition, it is assumed that the element antennas 1 are arranged on the n-th concentric circle 2 from a position that rotates from the x-axis of the coordinates 4 by an angle $\Delta_n$.

Then, the operation of the antenna device in accordance with this embodiment will be described. The antenna device in accordance with this embodiment obtains a desired radiation characteristic by applying a given excitation amplitude and excitation phase to the element antennas 1. In the first embodiment, there is considered a case in which the excitation phase is given to the respective element antennas 1 so that the radiation phases of the respective element antennas 1 become in phase in a desired direction ($\theta_0$, $\phi_0$). Assuming that an angle $\phi$ of an $m_n$-th element antenna 1 on an x-y plane as counted from the x-axis on the n-th concentric circle 2 is $\phi'm_n$, and the wave-number in a free space is k, a radiation characteristic $f(\theta, \phi)$ of the antenna is represented by the following expression (1).

Expression (1)

$$f(\theta,\phi)=\frac{1}{E_{all}}\sum_{n=1}^{N}E_n\sum_{m_n=1}^{M_n}\exp[j\cdot k\cdot a_n\{(\sin\theta\cos\phi\cos\phi'_{m_n}+\sin\theta\sin\phi\sin\phi'_{m_n})-(\sin\theta_0\cos\phi_0\cos\phi'_{m_n}+\sin\theta_0\sin\phi_0\sin\phi'_{m_n})\}]$$

where $$E_{all}=\sum_{n=1}^{N}E_n\cdot M_n$$

The above expression (1) is represented by the wave-number space with $\sin\theta\cos\phi$ and $\sin\theta\sin\phi$ as orthogonal axes as the following expression (2). In the following expression (2), $J_n$ is an n-order first Bessel function.

Expression (2)

$$f(\theta,\phi)=\frac{1}{E_{all}}\sum_{n=1}^{N}\left[E_n\cdot M_n\cdot\left\{\underline{J_0(k\cdot a_n\cdot\rho)}+\underline{\underline{2\sum_{q=1}^{\infty}j^{M_n\cdot q}\cdot J_{M_n\cdot q}(k\cdot a_n\cdot\rho)\cdot\cos(M_n\cdot q\cdot(\xi-\Delta_n))}}\right\}\right]$$

-continued where $$\rho=\sqrt{(\sin\theta\cos\phi-\sin\theta_0\cos\phi_0)^2+(\sin\theta\sin\phi-\sin\theta_0\sin\phi_0)^2}$$

$$\cos\xi=\frac{(\sin\theta\cos\phi-\sin\theta_0\cos\phi_0)}{\left(\sqrt{(\sin\theta\cos\phi-\sin\theta_0\cos\phi_0)^2+(\sin\theta\sin\phi-\sin\theta_0\sin\phi_0)^2}\right)}$$

It is found from the above expression (2) that the radiation characteristic of the wave-number space has the amplitude change in a sine shape on a circumference which is at a constant distance $\rho$ from the beam direction ($\sin\theta_0\cos\phi_0$, $\sin\theta_0\sin\phi_0$) as shown in FIG. 3. In FIG. 3, the interior of the circumstance which is at a distance 1 from the origin of the wave-number space coordinates 5 is a radiation pattern (visible region 6) which appears in an actual physical space.

In addition, it is found from the above expression (2) that although a singly underlined portion having a 0-order first Bessel function contributes to a main beam (position of $\rho=0$) and a side lobe (region of $\rho>0$), because a doubly underlined portion is formed by a first Bessel function of 1 or more order having no value at the time of $\rho=0$, the doubly underlined portion contributes to only the side lobe of $\rho>0$.

A first Bessel function $J_n(x)$ of 1 or more order is very small in value generally at the time of x=0 to n, and changes in a sine shape at the time where x is larger than that range. Therefore, when the term of q=1 on the doubly underlined portion of the expression (2) is sufficiently small within the visible region 6, the term of q>0 can be ignored, and the entire doubly underlined portion becomes small.

In other words, when the number of element antennas $M_n$ on each of the concentric circles 2 is larger to some degree, the doubly underlined portion of the expression (2) can be ignored in the visible region 6, and the radiation characteristic can be evaluated by only the term of the singly underlined portion. Also, in this case, the radiation pattern does not depend on a circumferential variable $\xi$ of the wave-number space and has a constant amplitude on the circumference which is at a constant distance $\rho$ from the beam direction ($\sin\theta_0\cos\phi_0$, $\sin\theta_0\sin\phi_0$). That is, the radiation pattern has a radiation characteristic which is rotationally symmetric about the beam direction used as a center in the wave-number space.

In this example, a reference interval of the concentric circles 2 is represented by d, and a radius of the n-th concentric circle 2 is represented by $a_n=L_n\cdot d$. Here, $L_n$ is the radius coefficient. When the doubly underlined portion of the above-mentioned expression (2) is omitted, the radiation characteristic is represented by the following expression (3).

Expression (3)

$$\begin{aligned}f(\theta,\phi)&=\frac{1}{E_{all}}\sum_{n=1}^{N}[E_n\cdot M_n\cdot\{J_0(k\cdot a_n\cdot\rho)\}]\\&=\frac{1}{E_{all}}\sum_{n=1}^{N}[E_n\cdot M_n\cdot\{J_0(k\cdot L_n\cdot d\cdot\rho)\}]\\&=\frac{1}{E_{all}}\sum_{n=1}^{N}[E_n\cdot M_n\cdot\{J_0(L_n\cdot u)\}]=f(u)\end{aligned}$$

where $$u=k\cdot d\cdot\rho$$

The expression (3) is expressed by the u-coordinate of the wave-number space. The radiation characteristic of FIG. 11(*a*) shows a case in which the intervals of all of the concentric circles 2 are equal to each other ($L_n$=n), the amplitudes of all of the element antennas 1 are equal to each other ($E_n$=1), and the circumferential element intervals on all of the concentric circles 2 are equal to each other ($M_n \propto L_n$), as described above.

Then, in FIG. 11(*a*), a reason that a large sub lobe occurs in the vicinity of the coordinates u=6.3 or u=12.6 in the wave-number space will be described.

Figure 4:
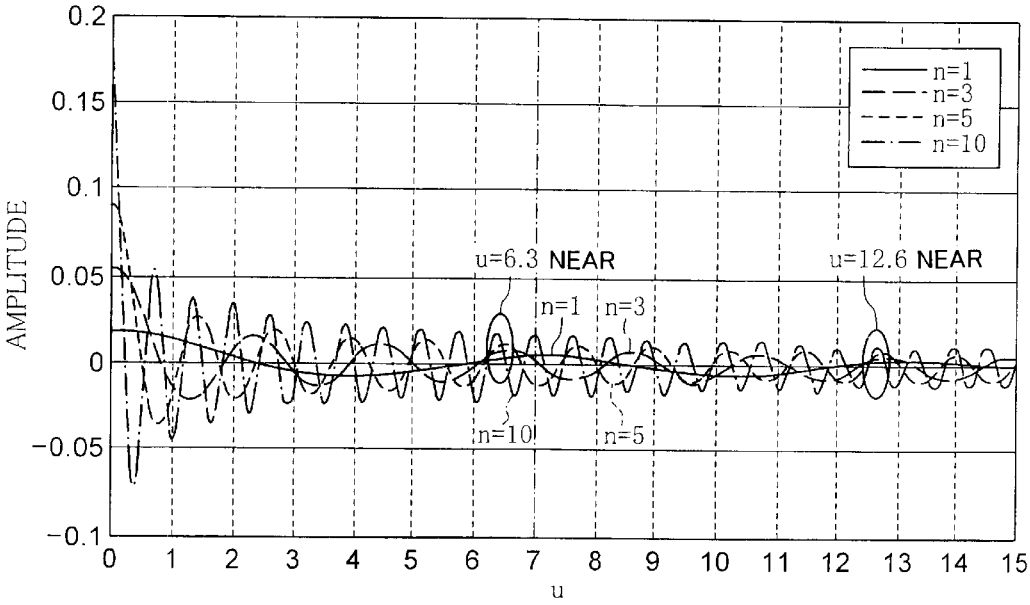
FIG. 4 is a graph showing the respective radiation characteristics of concentric circles in the case of a radius coefficient $L_n$=1, 3, 5 and 10 in the concentric circle arrangement array antenna.
Figure 11A:
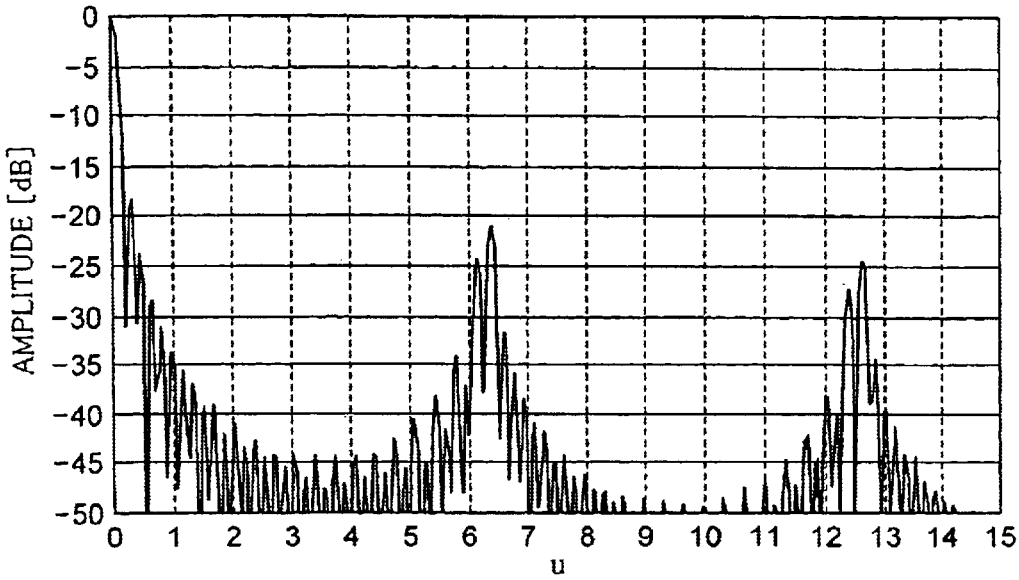
FIG. 11(a) PRIOR ART
FIG. 11 are graphs showing the composite radiation characteristic (conventional example) of a regular-interval concentric circle arrangement (the number of concentric circles is 18) and the composite radiation characteristic (third embodiment) of an irregular-interval concentric circle arrangement (the number of concentric circles is 18)
Figure 11B:
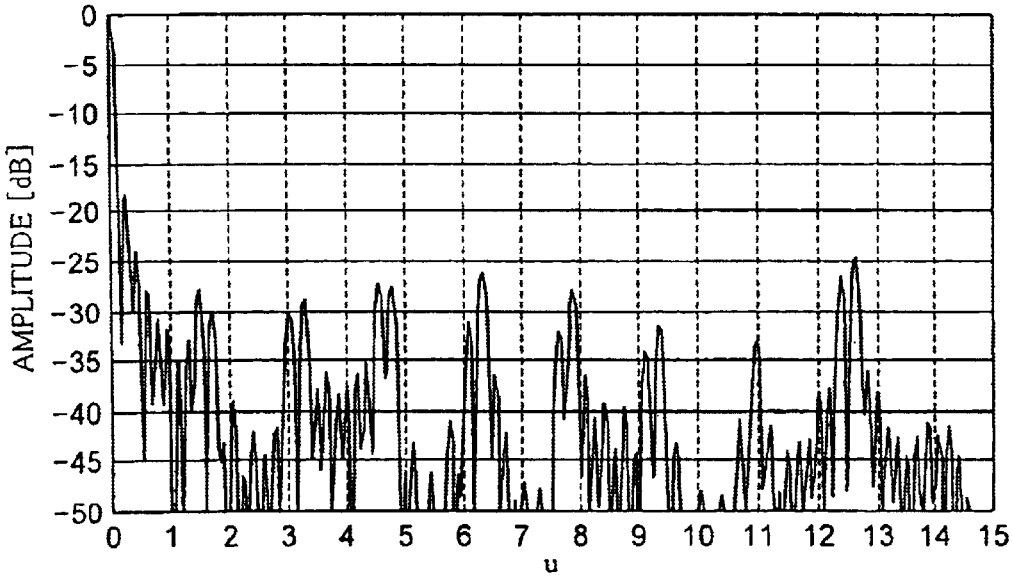
FIG. 11(b) PRIOR ART
Figure 12:
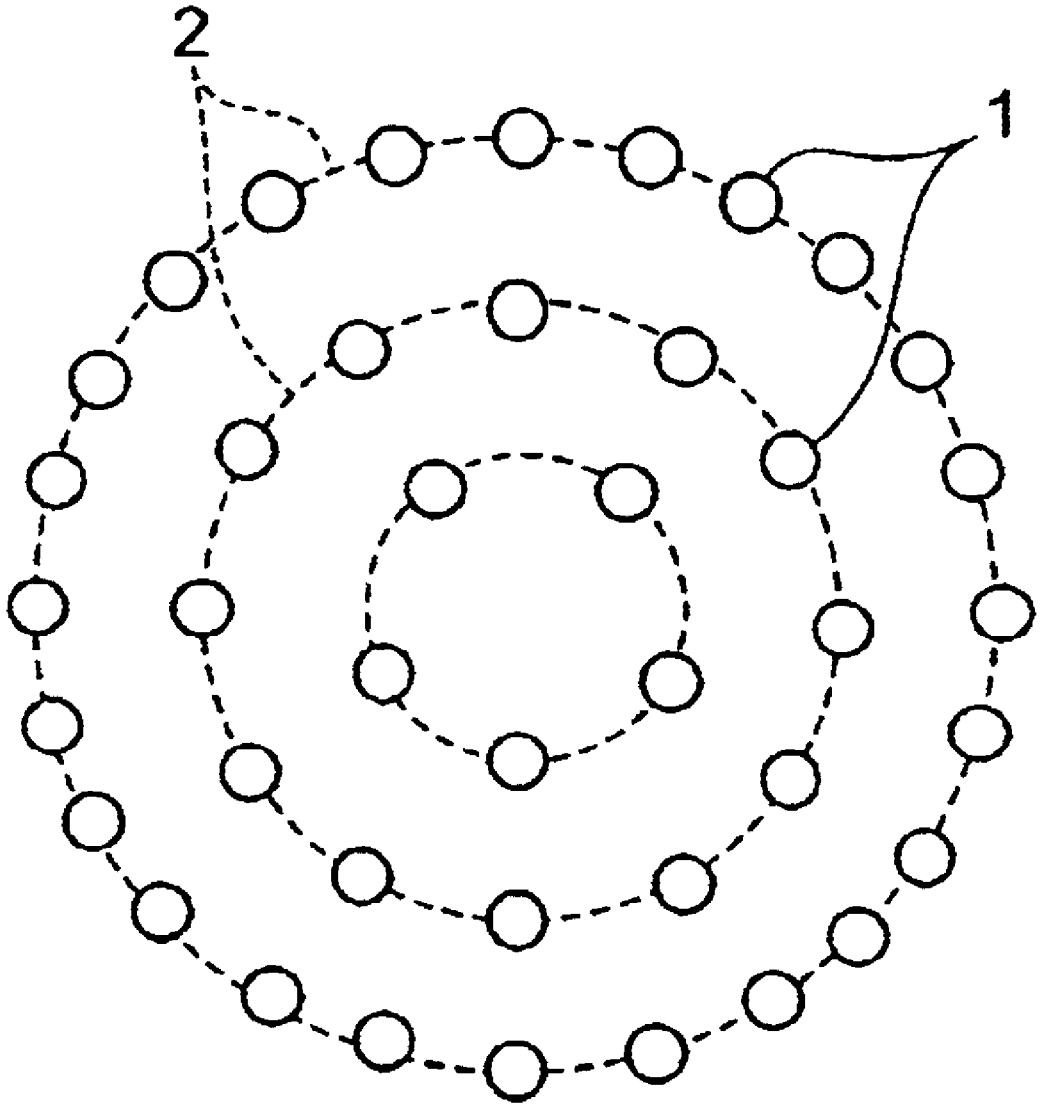
FIG. 12 PRIOR ART
FIG. 12 is a diagram showing a structure of a conventional antenna device.
Figure 13:
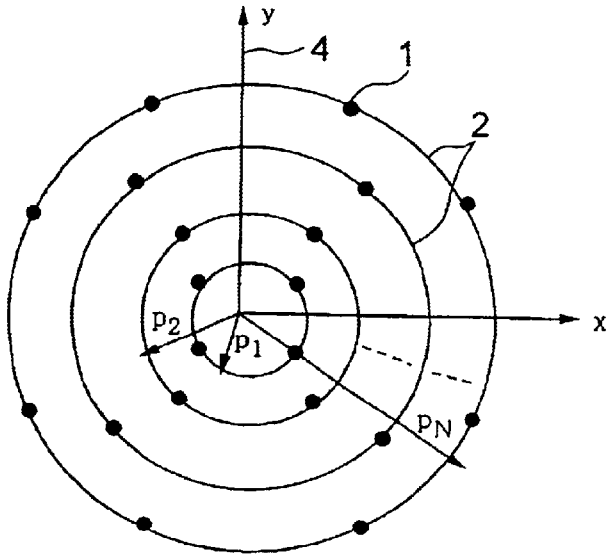
FIG. 13 PRIOR ART
FIG. 13 is a diagram showing a structure of another conventional antenna device.

FIG. 4 shows the respective radiation characteristics of the radius coefficient $L_n$=1, 3, 5 and 10 on the concentric circle 2 in the concentric circle arrangement array antenna having the radiation characteristic shown in FIG. 11 (*a*). The calculation is made through the expression (3). The amplitude of the axis of ordinate is represented by a field antilog value so that a phase relationship can be understood.

As is apparent from FIG. 4, in the case where the radii of all of the concentric circles 2 have the radius coefficient $L_n$=m, and m is an integer (including a case in which the intervals of all of the concentric circles 2 are equal to each other), the radiation characteristics of the respective concentric circles 2 become substantially in phase in the vicinity of the coordinates u=6.3 or u=12.6 in the wave-number space. For that reason, a large side lobe occurs.

Then, a specific example of the first embodiment and its advantages will be described. For simplification, the concentric circle arrangement array is supposedly considered, which consists of two concentric circles 2. It is assumed that the radius coefficient thereof is $L_1$=7 and $L_2$=8 in the expression (3).

Figure 5:
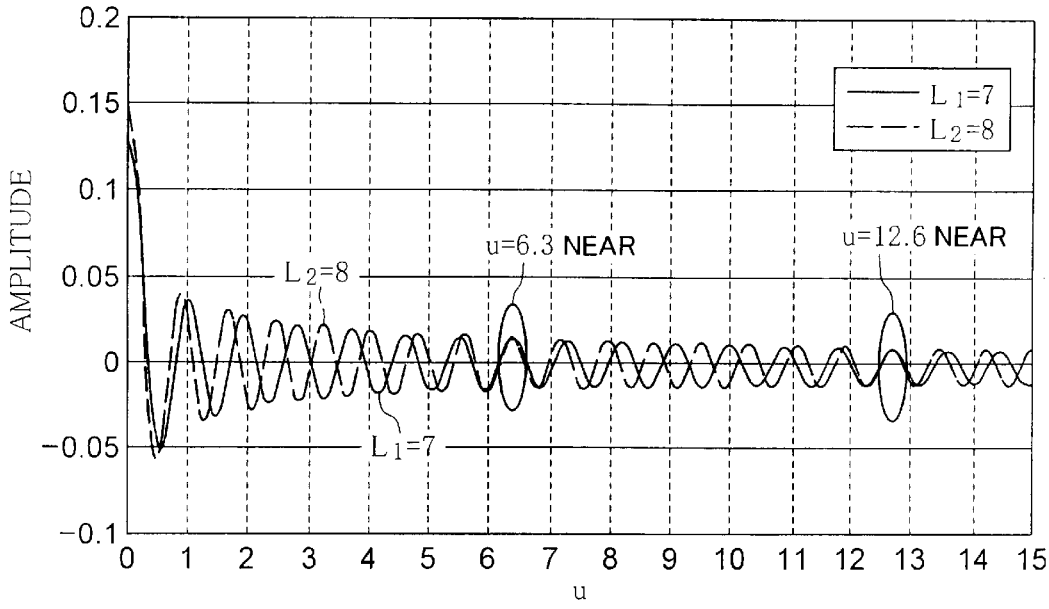
FIG. 5 is a graph separately showing the respective radiation characteristic of the concentric circle arrangement array antennas.

FIG. 5 is a graph showing the respective radiation characteristics of the concentric circle arrangement array, separately. Because it shows a case in which the radius coefficient $L_n$=m, and m is an integer as described above, both of the radiation characteristics become substantially in phase in the vicinity of the radius coefficient coordinates u=6.3, or u=12.6 as in FIG. 4. Strictly, the concentric circle of the radius coefficient $L_1$=7 has a peak at the time of u=6.4.

In this example, when the value of the radius coefficient $L_2$ is adjusted such that the valley of the concentric circle 2 having the radius coefficient $L_2$ is superimposed on a peak of the coordinates u=6.4 in the concentric circle 2 of the radius coefficient $L_1$=7, the side lobe in the vicinity of the coordinates u=6.3 in the composite pattern of those concentric circles has to attenuate. Since the valley of the concentric circle 2 having the radius coefficient $L_2$=8 is at the coordinates u=6, the radius coefficient $L_2$=8×6/6.4=7.5 is newly set.

Figure 6A:
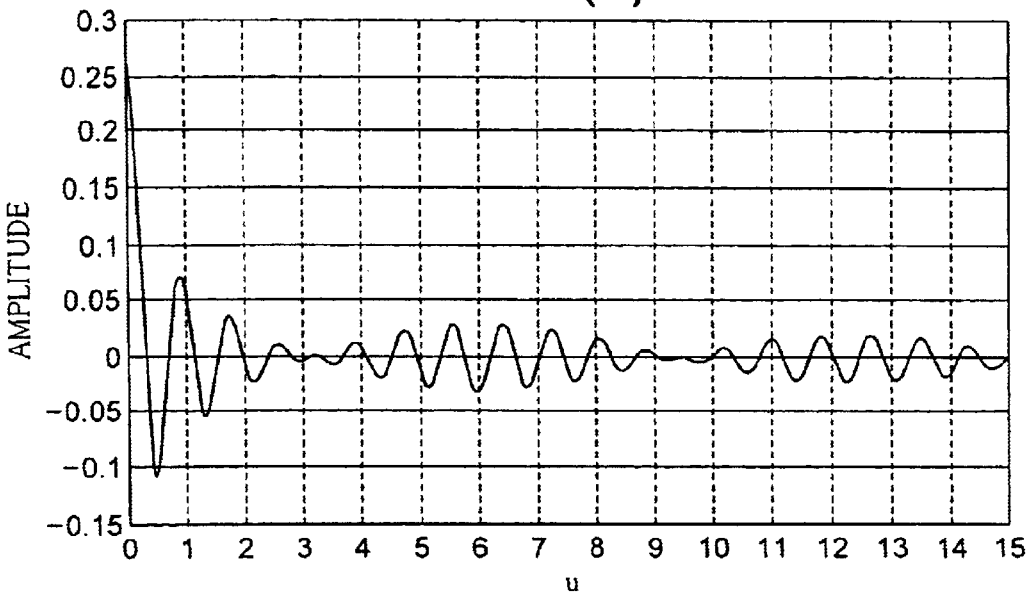
FIG. 6 are graphs showing the radiation characteristics of the entire array in the case where a radius coefficient $L_1$=7 and a radius coefficient $L_2$=8, and in the case where the radius coefficient $L_1$=7 and the radius coefficient $L_2$=7.5, in accordance with the first embodiment of the present invention, respectively.
Figure 6B:
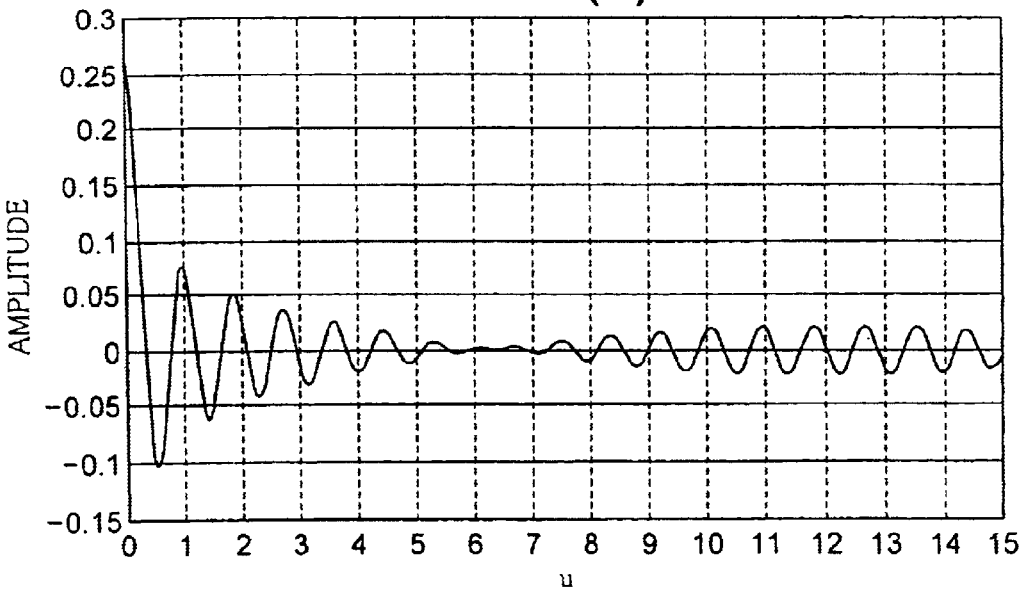

FIG. 6(*a*) shows the radiation characteristic of the entire array in the case of the radius coefficient $L_1$=7 and the radius coefficient $L_2$=8, and FIG. 6(*b*) shows the radiation characteristic of the entire array in the case of the radius coefficient $L_1$=7 and the radius coefficient $L_2$=7.5. It is found from FIGS. 6(*a*) and 6(*b*) that the side lobe at a wide angle (in particular, u>4) is reduced by adjusting the radius of the concentric circle 2 having the radius coefficient $L_2$.

A reduction of the side lobe at the wide angle u can be made by adjusting the radius of the concentric circles 2 that are adjacent to each other. Since this manner superimposes the adjacent peak and valley on each other, the variation of the radius coefficient $L_2$ is generally ±0.4 to 0.6.

Similarly, in the case where a larger number of concentric circles 2 are provided, the radii of the partial concentric circles 2 are adjusted in the same manner, thereby being capable of reducing the wide-angle side lobe.

As described above, in the first embodiment, the radii of the parts of plural concentric circles 2 are allowed to change by ±0.4 to 0.6d (d is a reference interval of the concentric circles 2) with the advantage that the wide-angle side lobe is reduced.

Second Embodiment

Figure 7:
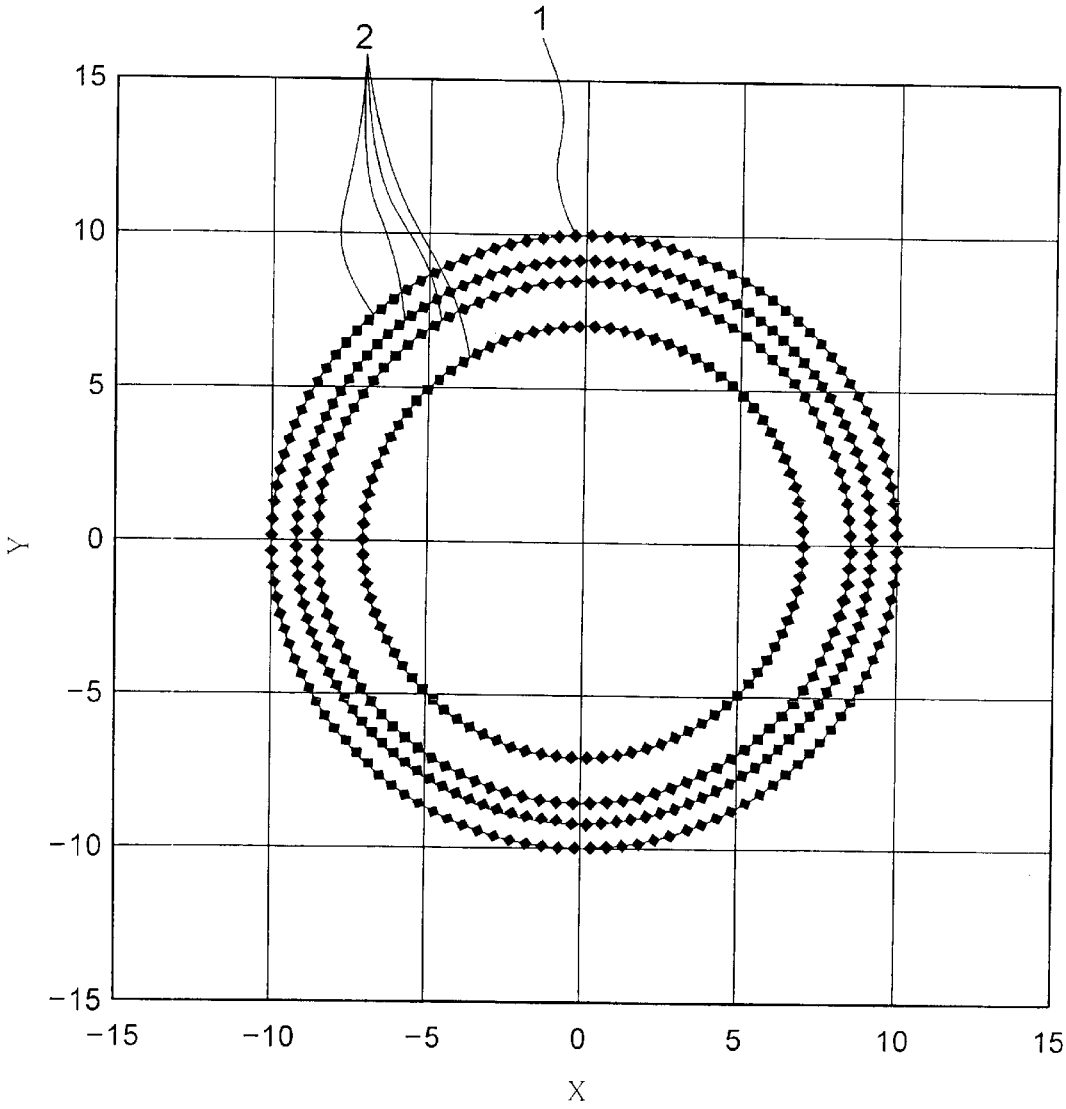
FIG. 7 is a diagram showing a structure of an antenna device in accordance with a second embodiment of the present invention.

An antenna device in accordance with a second embodiment of the present invention will be described with reference to the accompanying drawings. FIG. 7 is a diagram showing a structure of the antenna device in accordance with the second embodiment of the present invention.

Referring to FIG. 7, reference numeral 1 denotes a plurality of element antennas, and reference numeral 2 is concentric circles along which the plurality of element antennas 1 is arranged.

In this example, the concentric circle arrangement array is considered, which consists of four concentric circles 2. As the radius coefficient, $L_1$=7, $L_2$=8, $L_3$=9 and $L_4$=10 are first set. In this example, the radius of the concentric circle 2 having the radius coefficient $L_2$ is adjusted to provide $L_2$=8.44. This is set to superimpose the peak of u=6.4 when $L_1$=7 on the valley of u=6.75 when $L_2$=8 in FIG. 5, and is obtained as the radius coefficient $L_2$=8×6.75/6.4=8.44. In this case, the composite radiation characteristic of the radius coefficient $L_1$=7 and the radius coefficient $L_2$=8.44 is shown in FIG. 8(*a*), and the composite radiation characteristic of the radius coefficient $L_3$=9 and the radius coefficient $L_4$=10 is shown in FIG. 8(*b*).

Figure 8A:
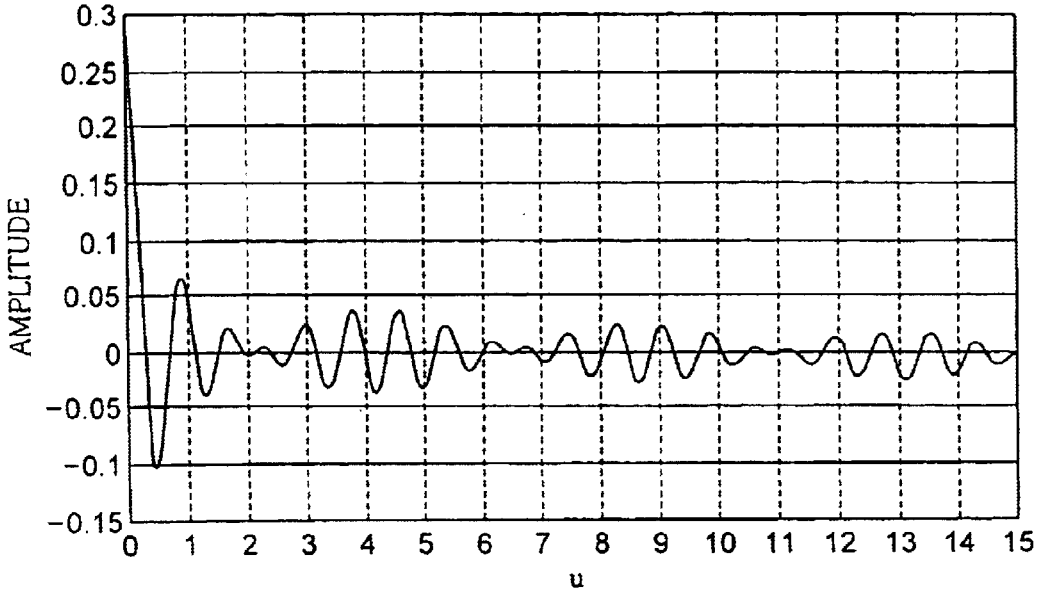
FIG. 8 are graphs showing a composite radiation characteristic of the radius coefficient $L_1$=7 and the radius coefficient $L_2$=8.44 and the composite radiation characteristic of a radius coefficient $L_3$=9 and a radius coefficient $L_4$=10, in accordance with the second embodiment of the present invention, respectively.
Figure 8B:
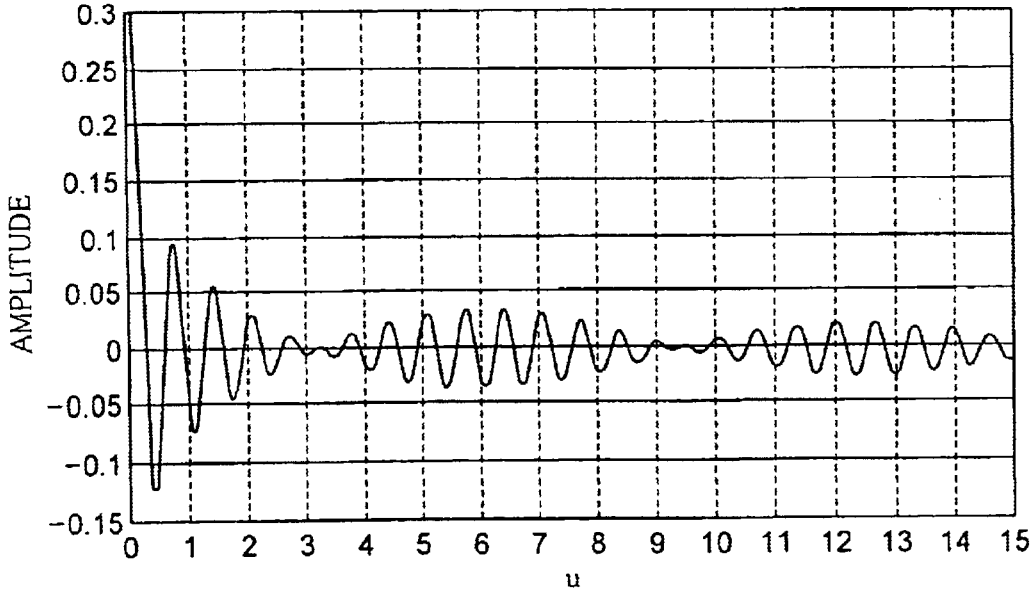

All of the radiation characteristics of FIG. 6(*a*) as well as FIGS. 8(*a*) and 8(*b*) are pulsations with respect to the u-axis of the wave-number space, and in this example, and an attention is paid to its envelope. The peaks and the valleys of the envelope in FIG. 6(*a*) showing the radiation characteristic of the radius coefficient $L_1$=7 and $L_2$=8 substantially correspond to the peaks and the valleys of the envelope in FIG. 8(*b*) showing the radiation characteristic of the radius coefficient $L_3$=9 and the radius coefficient $L_4$=10. This means that the side lobe is liable to increase at a specific position in the case where the radius of the concentric circle changes at intervals equal to the radius coefficients $L_1$=7, $L_2$=8, $L_3$=9 and $L_4$=10.

On the contrary, FIG. 8(*a*) showing the composite radiation characteristic of the radius coefficient $L_1$=7 and the radius coefficient $L_2$=8.44 is generally reverse to FIG. 8(*b*) in the peaks and the valleys of the envelope. Therefore, in the radiation characteristic that composes FIGS. 8(*a*) and 8(*b*), it is expected the side lobe be reduced.

Figure 9A:
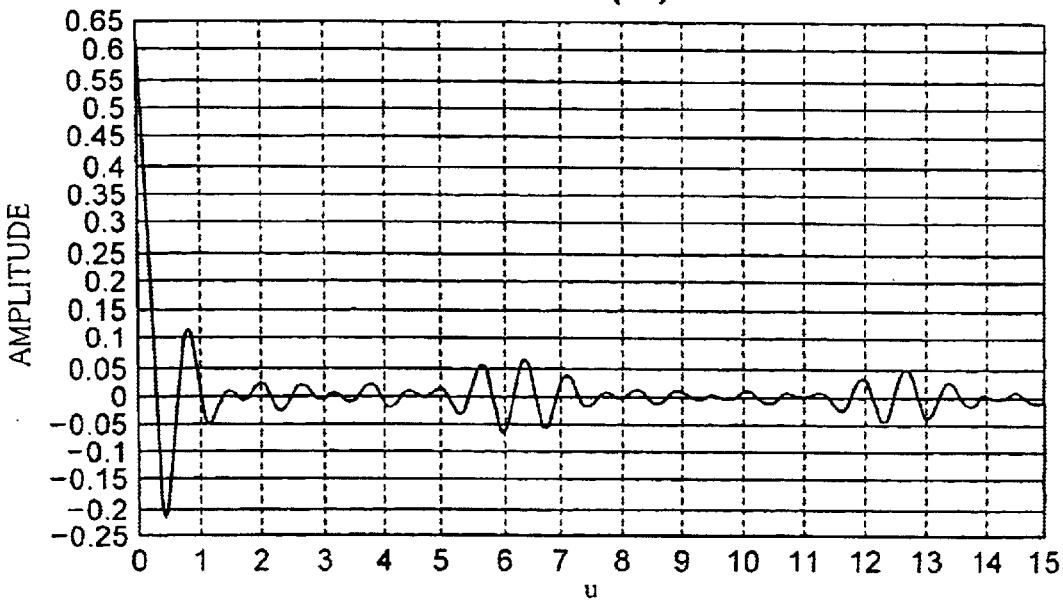
FIG. 9 are graphs showing the composite radiation characteristic in the case of the radius coefficients $L_1$=7, $L_2$=8, $L_3$=9 and $L_4$=10 and the composite radiation characteristic in the case of the radius coefficients $L_1$=7, $L_2$=8.44, $L_3$=9, and $L_4$=10, in accordance with the second embodiment of the present invention, respectively.
Figure 9B:
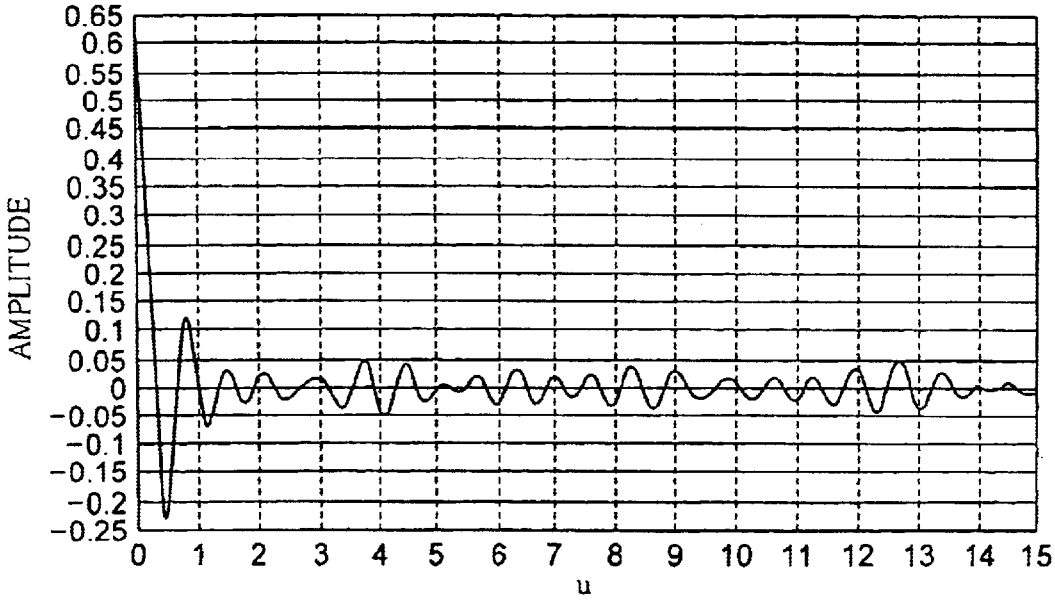

The composite radiation characteristics in the cases of the radius coefficients $L_1$=7, $L_2$=8, $L_3$=9 and $L_4$=10 and the radius coefficients $L_1$=7, $L_2$=8.44, $L_3$=9 and $L_4$=10 are shown in FIGS. 9(*a*) and 9(*b*), respectively. The latter radiation characteristic has the side lobe reduced at the wide angle (in particular, in the vicinity of u=6.3).

As described above, in the second embodiment, a manner is adopted in which two concentric circles 2 among which the radius of one concentric circle is adjusted to ±0.4 to 0.6d are combined with two concentric circles 2 both of which are not adjusted, that is, the radius of only one of four concentric circles 2 is adjusted to ±0.4 to 0.6d with the advantage that the wide-angel side lobe is reduced.

Third Embodiment

Figure 10:
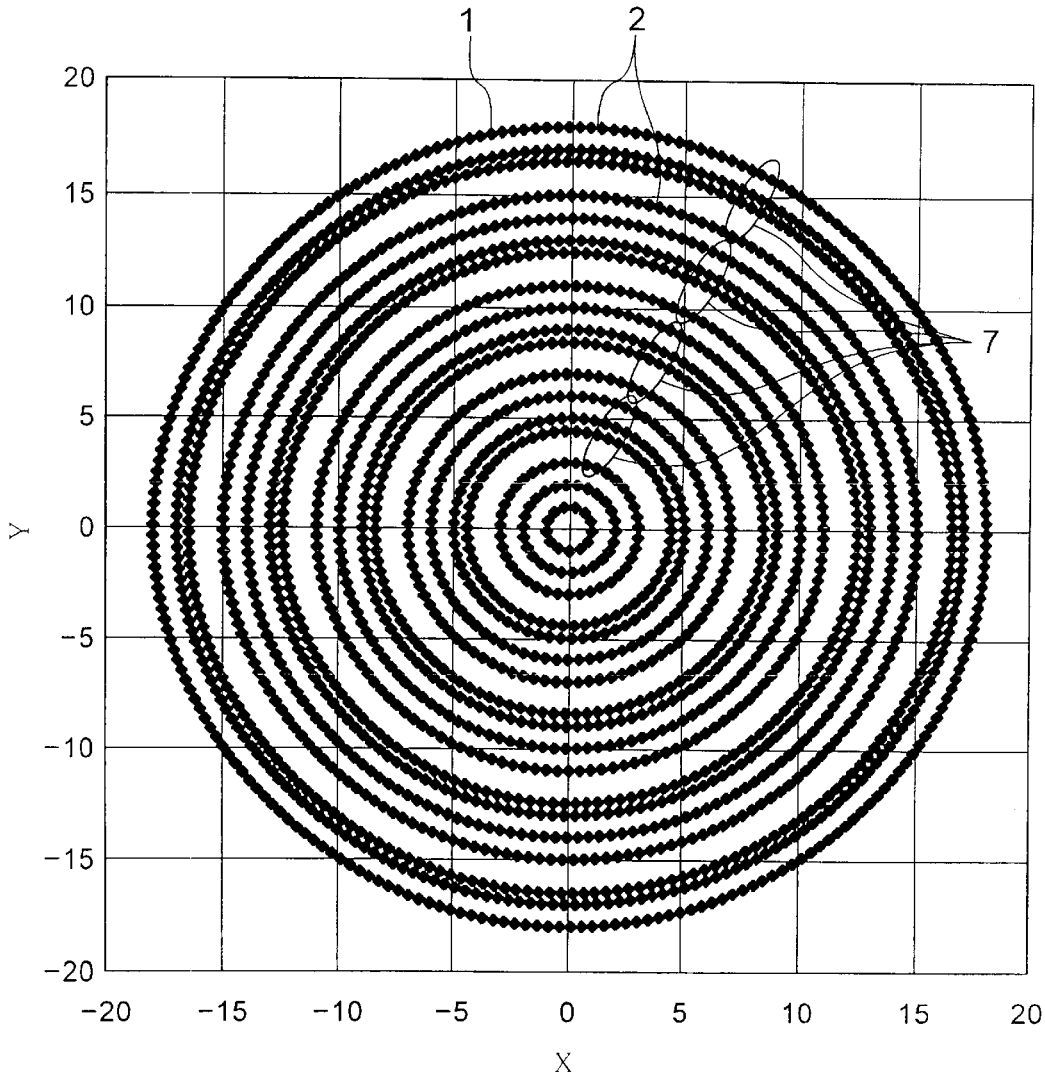
FIG. 10 is a diagram showing a structure of an antenna device in accordance with a third embodiment of the present invention.

An antenna device in accordance with a third embodiment of the present invention will be described with reference to the accompanying drawings. FIG. 10 is a diagram showing a structure of the antenna device in accordance with the third embodiment of the present invention.

Referring to FIG. 10, reference numeral 1 denotes a plurality of element antennas, and reference numeral 2 is a plurality of concentric circles along which the plurality of element antennas 1 is arranged. Also, reference numeral 7 designates a plurality of groups each of which consists of four concentric circles 2 which will be described later.

In the above-mentioned second embodiment, the side lobe is reduced by four concentric circles 2. However, in the array antenna including a larger number of concentric circles 2, the concentric circles 2 are bundled into a plurality of groups 7 each consisting of four concentric circles, and the radius of one concentric circle 2 in each of the groups 7 is adjusted to ±0.4 to 0.6d, thereby being capable of reducing the side lobe.

Also, in FIG. 10, X and Y are values that are standardized by a reference interval d of the concentric circles 2. In the third embodiment, there are provided 18 concentric circles 2, and the manner of the above-mentioned second embodiment is applied by the groups 7 of the concentric circles 2 of n=3 to 6, n=7 to 10, n=11 to 14 and n=15 to 18 apart from the concentric circles of n=1 and 2 which are small in the contribution to the radiation characteristic (n is a position from the inner side of the concentric circle 2). That is, $L_4$=4.43, $L_8$=8.44, $L_{12}$=12.47 and $L_{16}$=16.50 are set, and $L_n$=n is set at other positions.

FIG. 11(*b*) is a graph showing the composite radiation characteristic of the entire irregular-interval concentric circle arrangement. Also, for comparison, the radiation characteristics in the case where the above-mentioned adjustment is not conducted, that is, in the case where the intervals of all the concentric circles 2 are equal to each other ($L_n$=n in all of the concentric circles 2) are shown in FIG. 11(*a*).

In FIGS. 11(*a*) and 11(*b*), the axis of ordinate is indicated by dB. It is found from FIGS. 11(*a*) and 11(*b*) that the wide-angle side lobe is reduced, and a reduction of about 5 dB is made, in particular, in the vicinity of the coordinates u=6.3 through the manner of the third embodiment. That is, the wide-angle maximum side lobe level is reduced by 5 dB.

As described above, the manner of the third embodiment has such an advantage that the wide-angle side lobe level is reduced even in the array antenna having a larger number of concentric circles 2.

As was already described above, when the concentric circle intervals of the concentric circle arrangement are made large for the purpose of reducing the number of element antennas or the like, there arises such a problem that the side lobe which is high in level may occur even if no grating lobe that is found in a triangular arrangement or a rectangular arrangement appears. The above-mentioned respective embodiments show the manners for reducing the side lobe more in the concentric circle arrangement, and are greatly advantageous in that those embodiments can be particularly applied to even a case in which the concentric circle interval becomes one wavelength or longer. Also, those embodiments have an advantage that the number of element antennas is reduced by widening the concentric circle interval. In addition, in a phased array antenna where an expensive module is connected to each of the element antennas or the like, the advantage that the costs are reduced in accordance with the present invention is great.

What is claimed is:

1. An antenna device comprising a plurality of concentric circle array antennas each having a different radius on an identical plane, wherein a plurality of element antennas are arranged circumferentially in each of the concentric circle array antennas, wherein said plurality of concentric circle array antennas are arranged at regular intervals d in most part thereof, and wherein the concentric circle array antennas corresponding to a remaining part of said plurality of concentric circle array antennas are arranged at intervals d±(0.4 to 0.6)d.

2. An antenna device according to claim 1, wherein the interval of said plurality of concentric circle array antennas is set to one wavelength or longer.

3. An antenna device comprising a plurality of concentric circle array antennas each having a different radius on an identical plane, wherein a plurality of element antennas are arranged circumferentially in each of the concentric circle array antennas, wherein said plurality of concentric circle array antennas are divided into groups including four continuous concentric circle array antennas, and one of the four concentric circle array antennas which are included in each of the groups is arranged at an interval d±(0.4 to 0.6)d, and wherein the three remaining concentric circle array antennas in each of said groups are arranged at the regular intervals d.

4. An antenna device according to claim 3, wherein the interval of said plurality of concentric circle array antennas is set to one wavelength or longer.

5. An antenna device comprising:

a first concentric circle array antenna having a plurality of element antennas arranged at regular intervals in a circumferential direction and having a radius $a_n=L_n \cdot d$ where a radius coefficient is $L_n$ (n is an integer), and a reference interval of the concentric circle array antennas is d; and a second concentric circle array antenna having a plurality of element antennas arranged at regular intervals in a circumferential direction and having a radius $a_{n+1}=L_{n+1} \cdot d \pm (0.4 \text{ to } 0.6)d$.

6. An antenna device according to claim 5, wherein the interval of said first and second concentric circle array antennas is set to one wavelength or longer.

* * * * *